US011598036B2

(12) United States Patent
Wagner et al.

(10) Patent No.: US 11,598,036 B2
(45) Date of Patent: Mar. 7, 2023

(54) METHOD AND APPARATUS FOR MAKING A NONWOVEN FROM CRIMPED FILAMENTS

(71) Applicants: Tobias Wagner, Cologne (DE); Sebastian Sommer, Troisdorf (DE); Patrick Bohl, Hennef (DE); Andreas Roesner, Bonn (DE); Hans-Georg Geus, Niederkassel (DE)

(72) Inventors: Tobias Wagner, Cologne (DE); Sebastian Sommer, Troisdorf (DE); Patrick Bohl, Hennef (DE); Andreas Roesner, Bonn (DE); Hans-Georg Geus, Niederkassel (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 374 days.

(21) Appl. No.: 16/940,975

(22) Filed: Jul. 28, 2020

(65) Prior Publication Data

US 2021/0032789 A1 Feb. 4, 2021

(30) Foreign Application Priority Data

Jul. 30, 2019 (EP) ..... 19189215

(51) Int. Cl.

| | |
|---|---|
| ***D01D 5/088*** | (2006.01) |
| ***D01D 5/14*** | (2006.01) |
| ***D01D 5/22*** | (2006.01) |
| ***D01D 5/23*** | (2006.01) |
| ***D01D 5/34*** | (2006.01) |
| ***D01D 13/02*** | (2006.01) |
| ***D04H 3/16*** | (2006.01) |
| ***D02G 1/00*** | (2006.01) |

(52) U.S. Cl.

CPC ..... *D04H 3/16* (2013.01); *D02G 1/004* (2013.01)

(58) Field of Classification Search

CPC ..... D01D 5/08; D01D 5/088; D01D 5/14; D01D 5/22; D01D 5/23; D01D 5/34; D01D 13/00; D01D 13/02; D02G 1/004; D02G 1/10; D04H 3/11; D04H 3/14; D04H 3/147; D04H 3/16

USPC ..... 264/103, 168, 172.15, 210.2, 210.8, 264/211.14, 211.15, 211.17, 555; 425/66, 425/72.2, 326.1, 327, 367, 378.2, 379.1, 425/382.2, 461, 464; 28/104, 271

See application file for complete search history.

(56) References Cited

U.S. PATENT DOCUMENTS 5,575,874 A * 11/1996 Griesbach, III ..... D04H 3/16 156/181

2002/0086072 A1* 7/2002 Allen ..... D04H 3/16 425/72.2 X

* cited by examiner

*Primary Examiner* — Leo B Tentoni

(74) *Attorney, Agent, or Firm* — Andrew Wilford

(57) ABSTRACT

A nonwoven web is made by displacing an air-permeable mesh-belt conveyor in a horizontal travel direction and spinning and then depositing crimped continuous filaments as a web at a deposit region on the air-permeable mesh-belt conveyor. A first preconsolidation stage is provided downstream of the deposit region and a second preconsolidation separated by a suction gap from the first stage. Air is drawn air through the web and the conveyor at the deposit region at a first predetermined speed, the first and second consolidation stages at a second and third predetermined speeds, and at the suction gap either not at all or at a fourth predetermined equal to at most substantially less than the second predetermined speed.

15 Claims, 2 Drawing Sheets

METHOD AND APPARATUS FOR MAKING A NONWOVEN FROM CRIMPED FILAMENTS

FIELD OF THE INVENTION

The invention relates to an apparatus for making a nonwoven web from crimped filaments, in particular from crimped continuous filaments. The invention also relates to a method of making a nonwoven web from continuous filaments.

BACKGROUND OF THE INVENTION

In such an apparatus at least one spinneret or at least one spinning beam spins the filaments and deposits them on an air-permeable deposit conveyor, in particular a mesh belt, as a nonwoven web of the continuous filaments. Continuous filaments differ due to their almost endless length from staple filaments that have significantly shorter lengths of for example 10 mm to 60 mm. The nonwoven web made according to the invention is preferably composed of such continuous filaments. The apparatus according to the invention is particularly preferably a spunbonding apparatus, the method according to the invention is a spunbonding method and the nonwoven web made is a spunbonded nonwoven web.

An apparatus and method of the type described above are known from practice and from the prior art in various embodiments. For many applications, nonwoven webs having a considerable thickness and a high degree of softness are required. These are so-called high-loft products or high-loft nonwovens. Considerable thickness of a nonwoven web is usually achieved by using crimped filaments. In particular, multicomponent filaments or bicomponent filaments with side-by-side configuration or with eccentric core-sheath configuration are used for this purpose. Achieving a large thickness and considerable softness is often associated with a relatively low strength of the nonwoven web. This applies both to the tensile strength of the nonwoven web in the machine direction (MD) and to the abrasion resistance of the nonwoven web surface. Increases in thickness and/or softness generally have a detrimental effect on strength, and conversely increases in strength due to strengthening of the nonwoven web lead to a reduction in thickness and/or a decrease in softness of the nonwovens. Therefore, there is a conflict of objectives when creating high-loft products.

Another problem with the manufacture of high-loft nonwovens is that the deposited nonwoven webs often do not have the desired homogeneity, particularly with regard to their surface. Defect sites in the nonwoven surface or nonwoven area are often found. Such defect sites are mainly caused by backflow effects (so-called blow-back effects). When the nonwoven web deposited on the deposit conveyor changes from a more suctioned region of the deposit conveyor to a less suctioned region of the deposit conveyor, filaments or nonwoven components are withdrawn from the less suctioned region into the more suctioned region (blow-back effect). This results in disturbing defect sites or filament clumps in the nonwoven web or in the nonwoven web surface. Thus, there is room for improvement.

OBJECT OF THE INVENTION

The object of the invention is to provide an apparatus for making a nonwoven web from crimped filaments of the type described above that can make a nonwoven web of considerable thickness and softness, but also nevertheless distinguished by a satisfactory strength or abrasion resistance and still defect-free and in particular free of clumps.

In addition, another object of the invention is to provide a corresponding method of making a nonwoven web.

SUMMARY OF THE INVENTION

To attain this object, the invention proposes an apparatus for making a nonwoven web from crimped filaments, in particular from crimped continuous filaments, where at least one spinneret or at least one spinning beam is provided for spinning the filaments and/or continuous filaments, an air-permeable deposit conveyor, in particular a mesh belt, is provided for deposition of the filaments in a deposit region to form a nonwoven web, at least one first preconsolidater for preconsolidating the nonwoven web is provided downstream of the deposit region of the filaments in the travel direction of the nonwoven web, at least one suction device IS provided with which the air or process air in the deposit region of the filaments and/or at the first preconsolidation device can be sucked through the deposit conveyor or through the mesh belt, at least one second preconsolidater is downstream of the first preconsolidater in the travel direction of the nonwoven web for preconsolidating the nonwoven web, air or process air can be sucked through the deposit conveyor or through the mesh belt at the second preconsolidater, and a suction gap is provided in the region between the first preconsolidater and the second preconsolidater, no suction of air or process air takes place in the suction gap through the deposit conveyor or through the mesh belt and/or the suction gap is set up such that there is less or significantly less suction of air or process air than in the deposit region of the filaments and/or at the first preconsolidater, and/or that there is less suction of air or process air than at the second preconsolidater.

It is within the scope of the invention that the apparatus according to the invention is used as a beam component in a two-beam or multibeam system. A plurality of beams or beam components of the two-beam system or multibeam system can also be an apparatus according to the invention. To this extent, only one nonwoven web or a laminate can be made from a plurality of nonwoven webs one top the other within the scope of the invention.

The deposit conveyor or the mesh belt is preferably an endless revolving deposit conveyor or an endless revolving mesh belt. It is substantial within the scope of the invention that the at least two preconsolidations and the location of the suction gap is on one and the same deposit conveyor or mesh belt.

According to the invention, crimped filaments are made, and in particular crimped continuous filaments. In the scope of the invention, "crimped" means in particular that the crimped filaments or filaments each have a crimp with at least 1.5, preferably with at least 2, preferably with at least 2.5, and very preferably with at least 3 loops per centimeter of their length. According to a particularly recommended embodiment, the crimped filaments or filaments each have a crimp of 1.5 to 3.5 and preferably 2 to 3 loops per centimeter of their length. The number of crimp loops and/or crimp bows (loops) per cm length of the filaments/filaments is measured in particular according to the Japanese standard JIS L-1015-1981, by counting the crimps under a pretension of 2 mg/den in (1/10 mm), based on the unstretched length (crimped length) of the filaments. A sensitivity of 0.05 mm is used to determine the number of crimp loops. The measurement is expediently carried out using a "Favimat" apparatus from TexTechno, Germany. For this purpose, reference is made to the publication "Automatic Crimp Measurement on Staple Fibers," Denkendorf Colloqium, "Textile Mess- and Prüftechnik," Nov. 9, 1999, Dr. Ulrich Mörschel (in particular page 4, FIG. 4). For this purpose, the filaments or the filament sample are/is removed as a filament ball from the deposit or from the mesh belt before further solidification, and the filaments are separated and measured.

It is within the scope of the invention that bicomponent filaments or multicomponent filaments and in particular bicomponent filaments or multicomponent filaments are used to make the crimped filaments or filaments. Expediently, bicomponent filaments or multicomponent filaments having an eccentric core-sheath configuration or having a side-by-side configuration are used. Fibers or continuous filaments having an eccentric core-sheath configuration are preferred. The latter filaments have proven particularly useful for the apparatus according to the invention and for the method according to the invention. A very preferred embodiment of continuous filaments used in the scope of the invention having an eccentric core-sheath configuration is described in more detail below.

It is within the scope of the invention that the apparatus according to the invention is a spunbonding apparatus. According to the invention, the filaments or continuous filaments are spun with a spinneret. Expediently, at least one cooler for cooling the filaments and at least one stretcher adjoining the cooler for drawing the filaments are connected downstream of the spinneret in the travel direction of the filaments. At least one diffuser advantageously adjoins the stretcher in the travel direction of the filaments. A highly recommended embodiment of the invention is characterized in that the subassembly of the cooler and the stretcher is closed and that no other air is supplied from the outside to this subassembly apart from the supply of cooling air to the cooler. The filaments/filaments leaving the diffuser are expediently deposited directly on the deposit conveyor or on the mesh belt.

A particularly preferred embodiment of the invention is characterized in that a diffuser provided directly above the deposit conveyor or above the mesh belt has two opposite diffuser walls, two lower diverging diffuser wall portions being provided. The two lower diverging diffuser wall portions of the diffuser are preferably positioned asymmetrically with respect to the center plane M of the diffuser or the apparatus. It is recommended that the diffuser wall portion upstream with respect to the deposit conveyor enclose a smaller angle β with the center plane M of the diffuser than the diffuser wall portion downstream. Advantageously, the angle β, that the diffuser wall portion upstream encloses with the center plane M, is at least 1° smaller than the corresponding angle that the diffuser wall portion downstream encloses with the center plane M. The terms "upstream" and "downstream" refer here in particular to the travel direction or the running direction of the deposit conveyor or the mesh belt. The asymmetrical configuration of the diffuser with respect to the center plane M of the apparatus has proven particularly useful with regard to attaining the object according to the invention. It is within the scope of the invention that the ends of the diverging diffuser wall portions on the deposit conveyor side have a different spacing e from the center plane M of the apparatus. The spacing $e_1$ of the conveyor-side end of the diffuser wall portion upstream is preferably less than the spacing $e_2$ of the conveyor-side end of the diffuser wall portion downstream from the center plane M of the apparatus. The ratio of the spacings $e_1$:$e_2$ is expediently 0.6:1 to 0.95:1, preferably 0.65:1 to 0.9:1, and in particular 0.7:1 to 0.9:1.

A particularly preferred embodiment of the invention is further characterized in that the diffuser provided directly above the deposit conveyor or above the mesh belt has two opposing diffuser walls, at least two opposing secondary air inlet gaps being provided at the inflow end of the diffuser, which each are provided on one of the two opposing ones diffuser walls. "Inflow end" of the diffuser means here the end of the diffuser into which the stretched filaments or filaments enter. A lower secondary air volume flow can preferably be introduced through the secondary air inlet gap upstream with respect to the travel direction of the deposit conveyor than through the secondary air inlet gap downstream. According to one embodiment of the apparatus according to the invention, the secondary air inlet gap upstream in the machine direction (MD) is narrower than the secondary air inlet gap downstream. Machine direction (MD) means in the scope of the invention in particular the travel direction of the deposit conveyor or the mesh belt and thus the travel direction of the nonwoven web. It is within the scope of the invention that the width of the secondary air inlet gap upstream and/or the width of the secondary air inlet gap downstream is adjustable. It is recommended that the secondary air volume flow of the secondary air inlet gap upstream is at least 5%, preferably at least 10%, and in particular at least 15%, lower than the secondary air volume flow through the secondary air inlet gap downstream.

The spun, cooled, and stretched filaments or filaments are deposited in a deposit region of the deposit conveyor or the mesh belt to the nonwoven web. It is within the scope of the invention that process air is sucked from below through this deposit region of the filaments/filaments in a main suction region through the deposit conveyor or through the mesh belt. The process air in this main suction region is extracted at the suction velocity $v_H$. The main suction region is expediently delimited by a suction partition upstream and a suction partition downstream. It is within the scope of the invention that in a second suction region downstream of the main suction region in the machine direction (MD), process air is also sucked through the deposit conveyor or through the mesh belt with a suction velocity $v_2$. Furthermore, it is within the scope of the invention that the suction velocity $v_H$ in the main suction region is greater or significantly greater than the suction velocity $v_2$ in the second suction region. A particularly preferred embodiment of the invention is characterized in that the suction partition downstream between the main suction region and the second suction region has an end on the deposit conveyor side that is set at a vertical spacing A from the deposit conveyor. This vertical spacing A is expediently 10 mm to 250 mm, in particular 25 mm to 200 mm, preferably 28 mm to 150 mm, preferably 29 mm to 120 mm, very preferably 30 mm to 120 mm, and recommended 35 mm to 120 mm. A very proven embodiment is characterized in this context in that the suction partition downstream comprises, at its end on the conveyor side, a partition portion angled from the rest of the suction partition and a spoiler. The end of this spoiler on the conveyor side expediently maintains the vertical spacing A to the deposit conveyor or to the mesh belt. The relatively large spacing A between the conveyor-side end of the suction partition downstream and the deposit conveyor, or between the conveyor-side end of the spoiler and the deposit conveyor, brings very particular advantages with it within the scope of the invention. This embodiment enables a continuous or linearly continuous transition of the suction velocity from the main suction region having the high suction velocity $v_H$ to the second suction region having the lower or significantly lower suction velocity $v_2$. In particular, disadvantageous blow-back effects at the end of the main suction region are avoided and nonwoven webs having a very homogeneous and defect-free surface can be made. The vertical spacing A and the the preferred spoiler have proven particularly useful in the scope of the invention.

According to the invention, at least one first preconsolidater for preconsolidating the nonwoven web is provided in the travel direction downstream of the deposit region of the filaments. This first preconsolidater is expediently provided at the second suction region or above the second suction region. It is within the scope of the invention that the at least one first preconsolidater is a hot-air preconsolidater. According to a recommended embodiment, only a first preconsolidater or only an upstream hot-air preconsolidater is provided between the deposit region of the filaments and the suction gap. According to a particularly preferred embodiment of the invention, the at least one upstream hot-air preconsolidater is a hot-air knife. A proven embodiment of the invention is characterized in that only a hot-air preconsolidater, in particular in the form of a hot-air knife, is between the deposit region of the filaments and the suction gap. But it could also be a hot-air oven.

According to the invention, the suction gap is provided between the first preconsolidater and the second preconsolidater. This suction gap is described or detailed more below. At least one second preconsolidater is downstream of the at least one first preconsolidater and the suction gap for preconsolidating the nonwoven web in the travel direction of the nonwoven web. The at least one second preconsolidater is preferably a hot-air preconsolidater. According to a particularly recommended embodiment of the invention, this at least one downstream hot-air preconsolidater is a hot-air oven. A proven embodiment is characterized in that this hot-air oven is operated in the scope of a circulatory system and that preferably the mass flow delivered as hot air and the extracted mass flow are the same or approximately the same. It is within the scope of the invention that the mass flow sucked through the deposit conveyor is somewhat larger than the hot-air mass flow supplied. In this context, somewhat larger means that the difference can be up to a maximum of 25%, preferably up to a maximum of 10%, of the mass flow supplied. In this context, the apparatus is preferably set such that the entry of the nonwoven web into the region of the downstream hot-air preconsolidater is supported by a rectified air flow. In addition, evaporation from the nonwoven web can be removed from the circulating air in this way. Furthermore, it is within the scope of the invention that after the second preconsolidater or after the downstream hot-air preconsolidater, a cooling zone is provided on the deposit conveyor or on the mesh belt in order to stabilize the nonwoven web.

One embodiment is characterized in that only a second preconsolidater or only a downstream hot-air preconsolidater and preferably only a hot-air oven for preconsolidating the nonwoven web is connected downstream of the suction gap according to the invention. It is also within the scope of the invention that process air is sucked through the deposit conveyor or the mesh belt below the second preconsolidater or below the downstream hot-air preconsolidater, respectively, namely in a third suction region with the suction velocity $v_3$.

According to a particularly preferred embodiment of the invention, the suction velocity $v_H$ in the main suction region is greater than the suction velocity $v_2$ in the second suction region and expediently the suction velocity $v_2$ of the second suction region is greater than the suction velocity $v_3$ of the third suction region. It is recommended that the suction velocity $v_2$ of the second suction region, in particular below the first preconsolidater, is 15% to 50%, in particular 25% to 40% and preferably 27% to 35% of the suction velocity $v_H$ of the main suction region. Furthermore, it is preferred within the scope of the invention that the suction velocity $v_3$ in the third suction region, preferably below the second preconsolidater, is 5% to 30%, in particular 7% to 25%, and preferably 7% to 12% of the suction velocity $v_H$ of the main suction region. It is within the scope of the invention that the suction velocity $v_3$ of the third suction region is lower than the suction velocity $v_2$ of the second suction region.

According to a preferred embodiment of the invention, no suction takes place in the suction gap between the at least one first preconsolidater and the at least one second preconsolidater, so that the suction velocity $v_L$ there is zero. According to another embodiment of the invention, a low suction takes place in the suction gap, preferably with a suction velocity $v_L$ that is less than the suction velocity $v_2$ of the second suction region and preferably also less than the suction velocity $v_3$ of the third suction region. The length L of the suction gap according to the invention in the machine direction (MD) or in the travel direction of the deposit conveyor is advantageously greater than the length of the deposit region for the filaments or filaments in the machine direction (MD) or in the travel direction of the deposit conveyor. It has proven itself within the scope of the invention that the length L of the suction gap is greater than the dimension in the machine direction (MD) in which a hot-air knife used as the upstream hot-air preconsolidater acts on the nonwoven web with hot-air. A particularly preferred embodiment of the invention is characterized in that the length L of the suction gap in the machine direction (MD) is 300 mm to 5000 mm, in particular 1000 mm to 4500 mm, and preferably 1200 mm to 4000 mm. It is within the scope of the invention that the length L of the suction gap is at least 30%, preferably at least 35%, preferably at least 40%, very preferably at least 45%, and in particular at least 50% of the spacing C between the first preconsolidater in the travel direction and the immediately following second preconsolidater in the travel direction. It is within the scope of the invention that the spacing C is 400 mm to 5200 mm, in particular 1100 mm to 4700 mm, and preferably 1300 mm to 4200 mm.

A preferred embodiment of the invention is characterized in that, with a low suction in the suction gap according to the invention, the suction velocity $v_L$ is only 1% to 15%, preferably 1.2% to 10%, preferably 1.4% to 8%, very preferably 1.5% to 5%, particularly preferably 1.6% to 4%, and in particular 1.7% to 3% of the main suction velocity $v_H$ in the main suction region. According to a highly recommended embodiment of the invention, the suction velocity $v_L$ in the suction gap is adjustable. It is also within the scope of the invention that, with low suction in the suction gap, the suction velocity $v_L$ is only 2% to 45%, preferably 2.4% to 30%, and very preferably 2.8% to 16%, and in particular 3.4% to 9% of the suction velocity $v_2$ in the second suction region. It has also proven useful that the suction velocity $v_L$ in the suction gap is lower than the suction velocity $v_3$ in the third suction region and that the suction velocity $v_L$ is at most 50%, preferably at most 45%, preferably at most 40%, and particularly preferably at most 30% of the suction velocity $v_3$ in the third suction region. In principle, according to another embodiment of the invention, the suction velocity $V_L$ in the suction gap can also be greater or somewhat greater than the suction velocity $v_3$ in the third suction region.

The invention is based on the discovery that the formation of a suction gap according to the invention considerably simplifies the production of nonwoven webs of high thickness and/or high softness. Furthermore, the invention is based on the knowledge that the nonwoven web made of the crimped filaments in the suction gap can relax, as it were, prior to further preconsolidation, and because the nonwoven web has no or only a very low hold-down force, the nonwoven web can develop enough thickness. In this way, high thickness and considerable softness of the nonwoven web can be ensured in an advantageous manner, with nevertheless sufficient strength of the nonwoven web achieved by the preconsolidations provided according to the invention. In this respect, the suction gap according to the invention has considerable advantages.

In addition to the advantages described above, the suction gap according to the invention also has other advantages. It is within the scope of the invention that at least one third preconsolidater for the nonwoven web can be introduced into the suction gap and can expediently be positioned on the deposit conveyor or on the mesh belt. It is particularly preferred that this third preconsolidater can be removed or is removable again from the suction gap or from the deposit conveyor if required. According to a very preferred embodiment of the invention, the third preconsolidater is at least one roll or roller and, as recommended, one roll pair or roller pair. The roll or roller, and preferably the roll pair or roller pair, is expediently pivoted into the suction gap if required and preferably also removed or pivoted out of the suction gap if necessary. When the roll pair or roller pair is pivoted in, a roll or roller is preferably pivoted from below up to the deposit conveyor and a roll or roller is pivoted from above down to the deposit conveyor. According to the tried and tested embodiment of the invention, the roller or the roller pair is a compacting roller or a pair of compacting rollers for compacting the nonwoven web on the deposit conveyor. In this respect, the invention is based on the knowledge that the suction gap according to the invention not only brings considerable advantages with regard to the quality of the nonwoven web or with regard to a high-loft product to be made, but can also be used as an additional preconsolidater.

The at least one roller or roll that can be pivoted into the suction gap or onto the deposit conveyor expediently has a diameter Z of 200 mm to 500 mm and in particular of 250 mm to 450 mm. A roll or roller pivoted from above down into the suction gap between the first preconsolidater and the second preconsolidater preferably has a spacing or horizontal spacing X of 50 mm to 800 mm, in particular of 60 mm to 700 mm, expediently from 70 mm to 600 mm and preferably from 100 mm to 500 mm, with respect to the first preconsolidater connected upstream in the machine direction. It is also within the scope of the invention that this roll or roller pivoted from above into the suction gap between the two preconsolidaters has a spacing Y or horizontal spacing Y from the second preconsolidater downstream in the machine direction of 50 mm to 1500 mm, in particular of 60 mm up to 1250 mm, and preferably from 100 mm to 1000 mm.

It is within the scope of the invention that a pivoting out of the roll or roller is associated with a transfer of the roll or roller to a, preferably vertical, spacing of at least 20 mm, expediently of at least 150 mm from the deposit conveyor. According to another embodiment of the invention, the roll or roller can also be moved laterally out of the region of the deposit conveyor and can then be in a parking position next to the apparatus.

At least one second preconsolidater extending from the suction gap according to the invention in the machine direction (MD) or in the travel direction of the deposit conveyor is expediently a hot-air preconsolidater and is preferably a hot-air oven and in particular as only a hot-air oven. According to one embodiment of the invention, the distance in the machine direction (MD) in which the hot-air oven applies heated air to the nonwoven web is larger or longer than the suction gap and, according to one embodiment variant, is even longer than the spacing C between the first preconsolidater and the second preconsolidater.

According to a particularly preferred embodiment of the invention, a hot-air knife is used as at least one upstream hot-air preconsolidater or as the upstream hot-air preconsolidater. A recommended embodiment is characterized in that the hot-air knife acts on the nonwoven web with heated air over a distance in the machine direction (MD) from 15 mm to 300 mm, in particular from 30 mm to 250 mm, and preferably from 40 mm to 200 mm. The spacing of the at least one hot-air nozzle of the hot-air knife to the surface of the deposit conveyor or to the surface of the mesh belt is expediently 2 mm to 200 mm, preferably 2 mm to 150 mm, and in particular 3 mm to 100 mm. It is within the scope of the invention that the nonwoven web is preconsolidated by the hot-air knife using heated air with a hot-air temperature of 80° C. to 250° C., in particular 100° C. to 200° C., and preferably 120° C. to 190° C. The heated air during hot-air preconsolidation with the hot-air knife is recommended to have a velocity of 1.9 to 8 m/s, in particular 2 to 6 m/s, and preferably 2.2 to 5.5 m/s.

According to a preferred embodiment of the invention, a hot-air oven is used as at least one downstream hot-air preconsolidater or as the downstream hot-air preconsolidater. According to the proven embodiment of the invention, the hot-air oven applies heated air to the nonwoven web over a width range in the machine direction (MD) from 280 mm to 2,000 mm, in particular from 290 mm to 1800 mm, and preferably from 300 mm to 1500 mm. It is recommended that the hot-air outlet openings of the hot-air oven are at a spacing of 12 mm to 200 mm, in particular from 20 mm to 150 mm, and preferably from 25 mm to 120 mm, from the surface of the deposit conveyor or from the surface of the mesh belt. It is recommended that the hot-air preconsolidation with heated air is carried out in the hot-air oven at a hot-air temperature of 110° C. to 180° C., in particular 115° C. to 170° C., and preferably 120° C. to 160° C. The heated air during hot-air preconsolidation with the hot-air oven is recommended to have a velocity of 1 to 2 m/s, in particular 1.1 to 1.9 m/s, and preferably 1.2 to 1.8 m/s.

It is within the scope of the invention that bicomponent filaments or multicomponent filaments are used to produce the crimped filaments or filaments. Bicomponent filaments or multicomponent filaments having an eccentric core-sheath configuration are particularly preferred. Bicomponent filaments or multicomponent filaments having an eccentric core-sheath configuration have proven very useful, in which the sheath in the filament cross section has a region of uniform thickness d or a substantially region of uniform thickness d of more than at least 20%, in particular over at least 25%, preferably over at least 30%, preferably over at least 35%, and very preferably over at least 40%, and particularly preferably over at least 45% of the filament circumference. It is recommended that the sheath of the filaments have a region of uniform thickness d or a substantially region of uniform thickness d over at least 50%, preferably over at least 55%, and preferably over at least 60% of the filament circumference. With these filaments, the core expediently takes up more than 50%, in particular more than 55%, preferably more than 60%, preferably more than 65% of the region of the filament cross section of the filaments with respect to the filament cross section. The core of these filaments as preferably seen in the filament cross section, has the shape of a segment of a circle, and has an arcuate or a substantially arcuate peripheral portion with respect to its circumference, and a flat or substantially straight peripheral portion. Furthermore, it is preferred for these filaments that the sheath of the filaments, as seen in the filament cross section, is formed in the shape of a segment of a circle outside of the sheath region with the region of uniform thickness d, this circular segment relative to the circumference thereof having an arcuate or substantially arcuate circumferential portion and a linear or substantially linear peripheral portion. According to a highly recommended embodiment, the thickness of the sheath of these preferred filaments in the range of the region of uniform thickness d or the substantially region of uniform thickness d of the sheath is less than 10%, in particular less than 8%, and preferably less than 7% of the filament diameter D or largest filament diameter D. It is also within the scope of the invention that in these preferred filaments with respect to the filament cross section, the spacing a of the center of gravity of the core from the centroid of the surface of the sheath is 5% to 38%, in particular 6% to 36% and preferably 6% to 34% of the filament diameter D or the largest filament diameter D.

A particularly recommended embodiment of the invention is characterized in that the filaments or filaments made according to the invention consist or substantially consist of at least one polyolefin. With regard to the preferably used bicomponent filaments or multicomponent filaments having an eccentric core-sheath configuration, preferably at least one component or both or all components consist of at least one polyolefin or substantially consist of at least one polyolefin. In the case of the filaments having an eccentric core-sheath configuration, at least the sheath preferably consists of at least one polyolefin or substantially consists of at least one polyolefin. According to a very proven embodiment, the sheath consists of polyethylene or substantially consists of polyethylene and the core preferably consists of polypropylene or substantially consists of polypropylene. According to another recommended embodiment, the core consists of at least one polyester or substantially consists of at least one polyester and the sheath consists of at least one polyolefin or substantially consists of at least one polyolefin. Polyethylene terephthalate (PET) is preferably used as polyester in the scope of the invention. In a proven embodiment, the core consists of PET or substantially consists of PET and the sheath preferably consists of a polyolefin, in particular of polyethylene, or substantially consists of polyethylene. Another embodiment is characterized in that the core consists or substantially consists of at least one polyester and that the sheath consists or substantially consists of at least one copolyester. It is within the scope of the invention that the plastic component of the sheath has a lower melting point than the plastic component of the core. In the scope of the invention, bicomponent filaments or multicomponent filaments having an eccentric core-sheath configuration have proven themselves whose sheath is made of polyethylene or substantially of polyethylene and whose core is made of polypropylene or substantially of polypropylene.

A preferred embodiment of the invention is characterized in that the components of the continuous filaments used in the scope of the invention or, in the case of continuous filaments having an eccentric core-sheath configuration, the core and/or the sheath made from at least one polymer consist or substantially consist of the group "polyolefin, polyolefin copolymer, in particular polyethylene, polypropylene, polyethylene copolymer, polypropylene copolymer; polyester, polyester copolymer, in particular polyethylene terephthalate (PET), PET copolymer, polybutylene terephthalate (PBT), PBT copolymer, polylactide (PLA), PLA copolymer." It is also within the scope of the invention to use mixtures or blends of the above-described polymers for the components or for the core and/or for the sheath. It is within the scope of the invention that the plastic used for the sheath has a lower melting point than the plastic used for the core.

The method in the scope of the invention is preferably carried out at a production velocity of at least 250 m/min, in particular at least 300 m/min. Advantageously, nonwoven webs with a basis weight of 12 to 50 g/m$^2$, preferably of 20 to 40 g/m$^2$, are made in the method in the scope of the invention.

It is within the scope of the invention that the titer of the filaments used for the nonwoven web is between 1 den and 12 den. According to a highly recommended embodiment, the titer of the filaments is between 1.0 den and 2.5 den, in particular between 1.5 den and 2.2 den, and preferably between 1.8 den and 2.2 den. In particular, filaments having a titer of 1.5 den to 2.2 den and preferably from 1.8 den to 2.2 den have proven particularly useful in the scope of the invention.

To attain the object, the invention further teaches a method of making a nonwoven web from crimped filaments, in particular from crimped continuous filaments, the filaments or filaments being spun and being deposited on an air-permeable deposit conveyor or mesh belt, wherein in the deposit region of the filaments, air or process air is sucked through the deposit conveyor or through the mesh belt in a main suction region, and the filaments are preconsolidated on the deposit conveyor in the machine direction (MD) downstream of the deposit region in at least one preconsolidation stage, air or process air is sucked through the deposit conveyor in a second suction region at the first preconsolidation stage, the filaments are preconsolidated in at least one second preconsolidation stage downstream of the first preconsolidation stage in the machine direction (MD), air or process air is sucked through the deposit conveyor at the second preconsolidation stage in a third suction region, and at least one suction gap is provided in the region between the first preconsolidation stage and the second preconsolidation stage in which no air or process air is sucked through the deposit conveyor and/or in which a lower or significantly less suction of air or process air is carried out than in the second suction region and/or in the third suction region.

The invention is based on the discovery that nonwoven webs having optimal properties and in particular having optimal surface properties can be made with the apparatus according to the invention and with the method according to the invention. In particular, high-loft nonwovens with great thickness and high softness can be made without any problems and these nonwovens are nonetheless distinguished by a completely satisfactory strength in the machine direction (MD) and also by a completely sufficient abrasion resistance. The invention is based in particular on the knowledge that the high-loft properties, in particular high thickness and high softness, can be optimally stabilized with the aid of the suction gap according to the invention between the first preconsolidater and the second preconsolidater. The suction gap contributes, as it were, to the fact that the thickness of the nonwoven web can relax in this section or that the nonwoven thickness can stabilize excellently here. With the upstream and downstream preconsolidaters, optimum strength can be set at the same time. The desired properties of the nonwoven web can be set in a targeted, reliable, and reproducible manner. It is also particularly advantageous in the scope of the apparatus and the method according to the invention that the nonwoven webs or nonwoven webs made can be made virtually without defects and, above all, have no disruptive inhomogeneities in their surface structure. In particular, disadvantageous filament clumps in the nonwoven web surface or in the nonwoven web surface can be avoided with the measures according to the invention. It should be emphasized that the considerable advantages mentioned can be achieved in a relatively simple and inexpensive manner.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
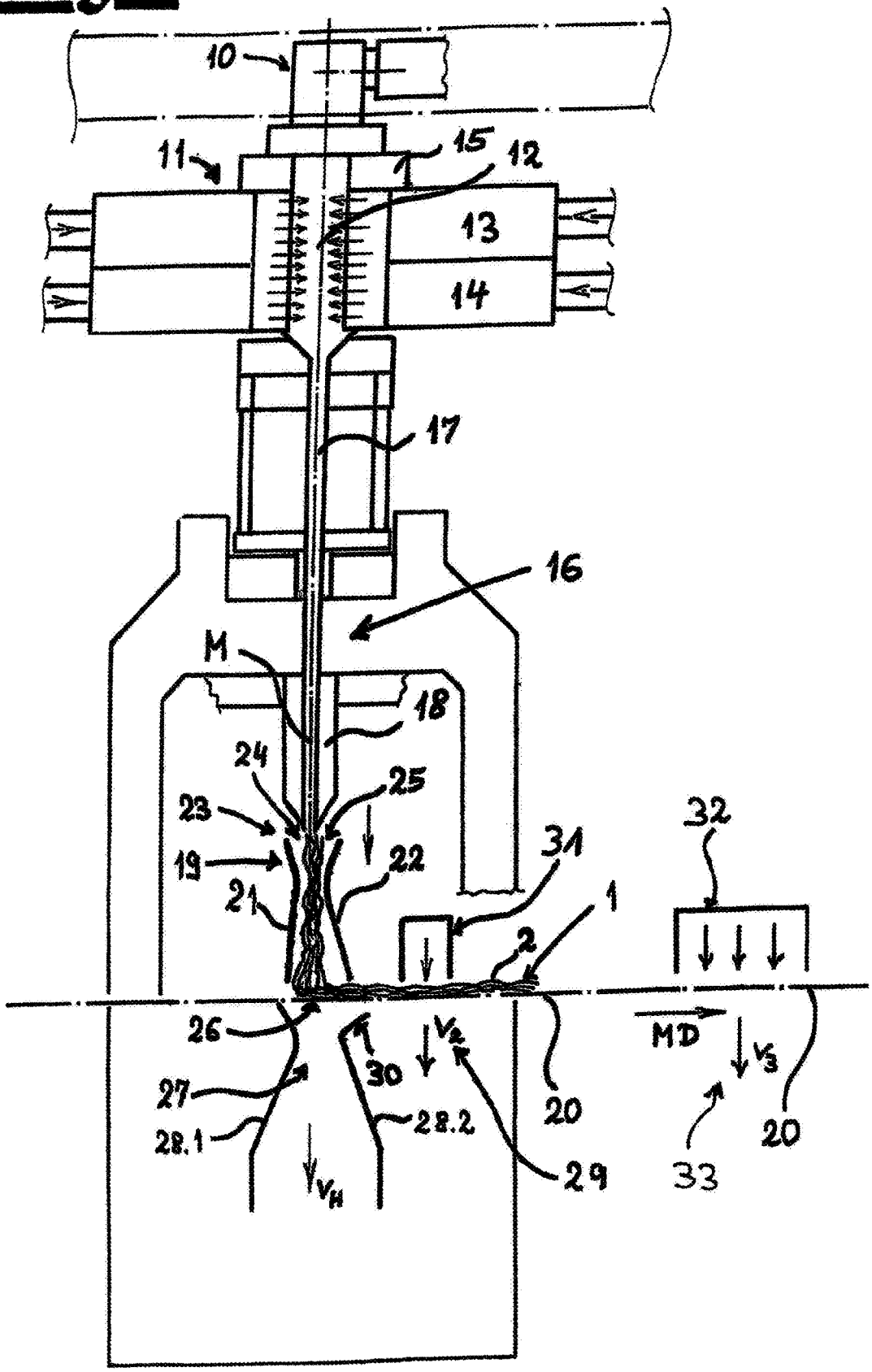
FIG. 1 is a largely schematic section through an apparatus according to the invention for making a spunbonded nonwoven web.

FIG. 1 shows an apparatus according to the invention for making a spunbonded nonwoven web 1 from continuous filaments 2 of thermoplastic resin. The apparatus has a spinneret 10 for spinning the continuous filaments 2 that then pass. downward through a cooler 11 having a cooling chamber 12. Preferably and in the embodiment according to FIG. 1, two vertically stacked air-supply manifolds 13 and 14 laterally flank the cooling chamber 12. Air of different temperatures is expediently introduced into the cooling chamber 12 from these air-supply manifolds 13 and 14. As recommended and in the embodiment, a monomer extractor 15 is provided between the spinneret 10 and the cooler 11. This monomer extractor 15 draws toxic gases made during the spinning process from the apparatus. These gases are, for example, monomers, oligomers, or decomposition products and the like.

The cooler 11 is preferably and in this embodiment followed in the filament flow direction by a downstream stretcher 16 that plastically elongates the continuous filaments 2. Preferably and here, the stretcher 16 has an intermediate passage 17 that connects the cooler 11 to a shaft 18 of the stretcher 16. According to a preferred embodiment and here, the subassembly of the cooler 11 and the stretcher 16 or the subassembly of the cooler 11, the intermediate passage 17, and the stretch shaft 18 is a closed assembly and, apart from the supply of cooling air in the cooler 11, entry of further air outside into this subassembly is blocked.

The stretcher 16 is preferably followed in this embodiment in the vertically downward filament flow direction by a diffuser 19 through which the continuous filaments 2 pass. After passing through the diffuser 19, the continuous filaments 2 are preferably and here deposited on a deposit conveyor a mesh belt 20. The mesh belt 20 is preferably and in this embodiment an endlessly rotating mesh belt 20. This mesh belt 20 is expediently foraminous so that suction of process air can take place from below through the mesh belt 20.

According to a preferred embodiment and here, the diffuser 19 has upstream and downstream diffuser walls extending transverse to a machine or travel direction MD and having respective lower diverging diffuser wall portions 21 and 22. These diverging diffuser wall portions 21 and 22 are preferably asymmetrical to the vertical center plane M of the apparatus or the diffuser 19. Appropriately and here, the upstream diffuser wall portion 21 forms a smaller angle β with the center plane M than the downstream diffuser wall portion 22. It is recommended that the angle β that the upstream diffuser portion 21 forms with the center plane M is at least 1° smaller than the angle β that the downstream diffuser wall portion 22 forms with the center plane M. It is within the scope of the invention that the ends of the diverging diffuser wall portions 21 and 22 on at their upper end edges have different spacings $e_1$ and $e_2$ from the center plane M of the apparatus or of the diffuser 19. The spacing $e_1$ of the upper end of the diffuser wall portion 21 upstream to the center plane M is preferred and in this embodiment less than the spacing $e_2$ of the upper end of the downstream diffuser wall portion 22 to the center plane M. The terms "upstream" and "downstream" refer in particular to the horizontal travel direction MD of the mesh belt 20 or to the travel direction of the nonwoven web. According to a preferred embodiment of the invention, the ratio of the spacings $e_1$:$e_2$ is 0.6:1 to 0.95:1, preferably 0.65:1 to 0.9:1, and in particular 0.7:1 to 0.9:1. The asymmetrical configuration of the diffuser 19 with respect to the center plane M has proven particularly useful with regard to attaining the object of the invention.

Furthermore, it is within the scope of the invention that two opposite secondary air inlet gaps 24 and 25 are provided at the upper intake end 23 of the diffuser 19, each at an upper end of a respective one of the two diffuser walls 21 and 22. A lower secondary air volume flow can preferably be introduced through the secondary air inlet gap 24 upstream relative to the travel direction of the mesh belt 20 or to the machine direction MD than through the secondary air inlet gap 25 downstream. It is recommended that the secondary air volume flow of the secondary air inlet gap 24 upstream is at least 5%, preferably at least 10% and in particular at least 15% lower than the secondary air volume flow through the secondary air inlet gap 25 downstream. The embodiment with the different secondary air volume flows has proven particularly useful with regard to attaining the object of the invention.

It is within the scope of the invention that at least one suction apparatus (not shown in the figures) is provided that draws air or process air through the mesh belt 20 below the deposit region 26 of the filaments 2 in a main suction region 27. This air or process air is sucked through the mesh belt 20 at a suction velocity $v_H$. The main suction region 27 is expediently delimited in this embodiment below the mesh belt 20 at an inlet region and in an outlet region of the mesh belt 20 by the upstream and downstream suction partition walls 28.1 and 28.2.

A very recommended embodiment of the invention is characterized in that the lower upper end of the downstream suction partition 28.2 is at a vertical spacing A from the deposit conveyor or the mesh belt 20, this spacing A being preferably 25 mm to 200 mm and particularly preferably 28 mm to 150 mm. As recommended and here, a partition portion or spoiler 30 is connected to the suction partition 28.2 downstream at the upper end. Preferably and here, the spoiler 30 is, as it were, an integral part of the suction partition 28.2 downstream and is an angled partition portion on this suction partition 28.2. The spoiler 30 is expediently an obliquely angled spoiler 30 of planar or substantially planar shape. Preferably and here, the spoiler 30 is angled from the respective suction partition 28.2 facing away from the center plane M of the main suction region 27. It is within the scope of the invention that the upper end of the spoiler 30 is at the above-mentioned spacing A from the deposit conveyor or the mesh belt 20. The preferably provided vertical spacing A and in particular the embodiment with the spoiler 30 is of particular importance with regard to making defect-free nonwoven webs. With this configuration, it is possible for the relatively high suction velocity $v_H$ in the main suction region 27 to decrease gradually and linearly gradually to a lower suction velocity downstream. In this way, disadvantageous blow-back effects on the nonwoven web can be successfully avoided. As a result, nonwoven webs can be made without disruptive filament clumps and thus nonwoven webs with a very homogeneous surface or surface structure.

Preferably and here, in a second suction region 29 downstream of the main suction region 27 air or process air is sucked through the deposit conveyor or through the mesh belt 20 at a suction velocity $v_2$. This suction velocity $v_2$ is lower or significantly lower than the suction velocity $v_H$ in the main suction region 27. The preferably provided vertical spacing A and in particular the spoiler 30 thus ensures a gradual, continuous transition of the suction velocities from the high suction velocity $v_H$ in the main suction region to the lower suction velocity $v_2$ in the second suction region 29.

Figure 2:
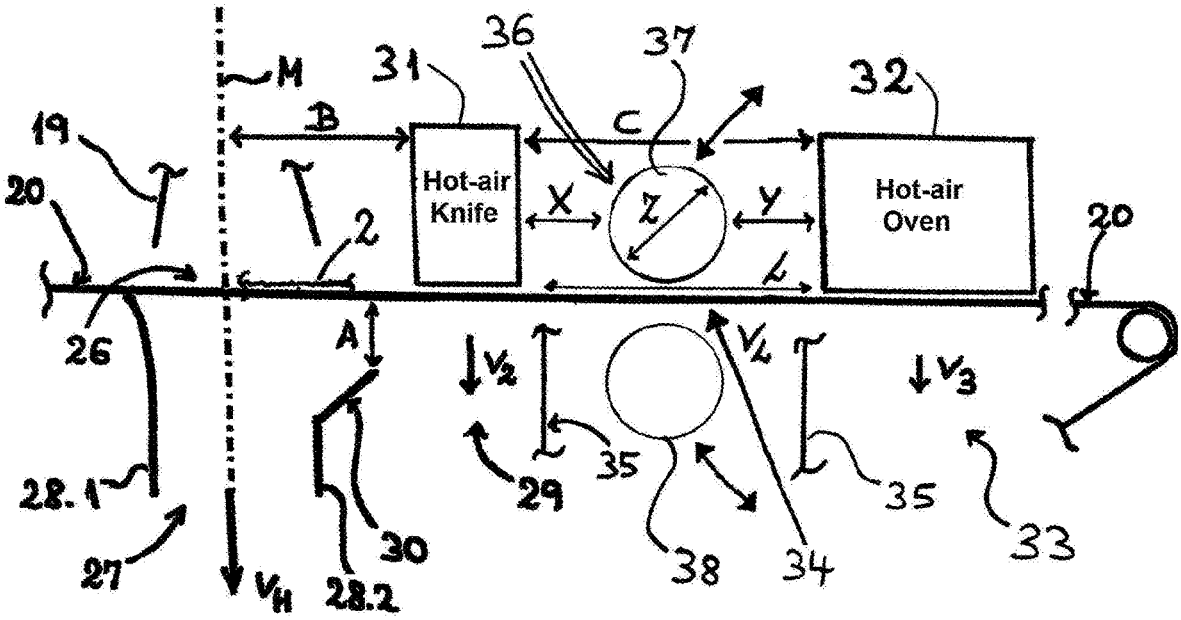
FIG. 2 is a large-section view of a detail of FIG. 1 at the deposit conveyor and preconsolidaters.

In particular, FIG. 2 shows a particularly preferred embodiment with respect to the preconsolidaters and to the suction gap 34 at the deposit conveyor or the mesh belt 20. Preferably and here, an upstream hot-air preconsolidater provided in the travel direction downstream of the deposit region 26 of the filaments, is a hot-air knife 31 as recommended in this embodiment. This upstream hot-air preconsolidater or this hot-air knife 31 is, as has been proven and as in this embodiment, above the second suction region 29 where process air is sucked through the mesh belt 20 at the suction velocity $v_2$. It is recommended that the spacing B between the upstream hot-air preconsolidater or the hot-air knife 31 and the center plane M of the apparatus be 100 mm to 1000 mm, preferably 110 mm to 600 mm, and preferably 120 mm to 550 mm. The spacing B is measured in particular between this center plane M and the first component or structural component of the upstream hot-air preconsolidater or the hot-air knife 31 following it in the travel direction.

A downstream hot-air preconsolidater is downstream of the upstream hot-air preconsolidater or the hot-air knife 31 in the machine direction MD, which is preferred and here is a hot-air oven 32. The horizontal spacing C in the direction MD between the upstream hot-air preconsolidater and the downstream hot-air preconsolidater, or between the hot-air knife 31 and the hot-air oven 32, is expediently 400 mm to 5200 mm and in particular 1100 mm to 4700 mm. At the downstream hot-air preconsolidater or at the hot-air oven 32, a further suction of process air takes place preferably and here through the mesh belt 20, specifically process air is suctioned here at a suction velocity $v_3$ in a third suction region 33. The individual suction regions below the mesh belt 20 are otherwise preferred and are separated from one another in this embodiment according to FIG. 2 by partitions 35. It is within the scope of the invention that the suction velocity $v_3$ in the third suction region 33 below the hot-air oven 32 is lower than the suction velocity $v_2$ in the second suction region 29.

The suction gap 34 according to the invention is between the upstream hot-air preconsolidater and the downstream hot-air preconsolidater. The length L of the suction gap 34 in the machine direction MD is preferably and here at least 80% of the spacing C between the upstream hot-air preconsolidater and the downstream hot-air preconsolidater. According to a recommended embodiment of the invention, no suction of process air takes place in the suction gap 34 through the mesh belt 20, so that the suction velocity $v_L$ is zero or approximately zero here. According to another embodiment, a little suction of process air takes place in the suction gap 34 through the mesh belt 20. The suction velocity $v_L$ in the suction gap 34 is then preferably lower or significantly lower than the suction velocity $v_2$ in the second suction region 29. According to a recommended embodiment of the invention, the suction velocity $v_L$ is also lower than the suction velocity $v_3$ in the third suction region 33 below the downstream hot-air preconsolidater.

FIG. 2 also shows a very particularly preferred embodiment of an apparatus according to the invention. In this embodiment, a third preconsolidater can be introduced into the suction gap 34 that is a compacting roller pair 36 in this embodiment according to FIG. 2. An upper compacting roller 37 can, if necessary, be pivoted from above down to the mesh belt 20, while a lower compacting roller 38 is pivoted from below up against the mesh belt 20. With the help of the compacting roller pair 36, the nonwoven web can be compacted in the suction gap 34. If compacting of the nonwoven web is not desired, the compacting roller pair 36 can be spread or swung out again from the region of the mesh belt 20 or the suction gap 34. In this respect, the apparatus according to the invention having the suction gap 34 according to the invention is also distinguished by a high degree of flexibility and variability with regard to the preconsolidation options. The consolidating rollers 37 and 38 expediently each have a diameter Z of 200 mm to 500 mm, preferably of 250 mm to 450 mm. It is within the scope of the invention that the diameters Z of the compacting rollers 37, 38 are not greater than the length L of the suction gap 34 and is expediently smaller than the length L of the suction gap 34. Basically, according to one embodiment, a maintenance catwalk (not shown in the figures) can also be provided at the suction gap 34 that extends transversely to the machine direction MD and ensures easy access to the system components for the maintenance personnel or operating personnel. This embodiment can be provided in particular if there is no suction of process air in the suction gap 34 and if the suction velocity $v_L$ is zero or approximately zero there.

If, according to the embodiment of the invention described above, an upper compacting roller 37 is provided in the suction gap 34, this compacting roller 37 has spacings X and Y from the adjacent hot-air preconsolidaters 31 and 32. It is within the scope of the invention that the spacing X and/or the spacing Y is smaller than the diameter Z of the compacting roller 37. The spacing X is the spacing from the upper compacting roller 37 to the upstream hot-air preconsolidater or to the hot-air knife 31 and the spacing Y is the spacing from the upper compacting roller 37 to the downstream hot-air preconsolidater or the hot-air oven 32. Both spacings X and Y are measured like the length L of the suction gap 34 and the spacing C between the two hot-air preconsolidaters in the machine direction MD and expediently in the horizontal machine direction MD. It is within the scope of the invention that the spacing X between the hot-air knife 31 and the upper compacting roller 37 is 100 mm to 500 mm, preferably 150 mm to 450 mm. Furthermore, it is within the scope of the invention that the spacing Y between the upper compacting roller 37 and the hot-air oven 32 is 50 mm to 1500 mm and preferably 100 mm to 1000 mm.

Figure 3:
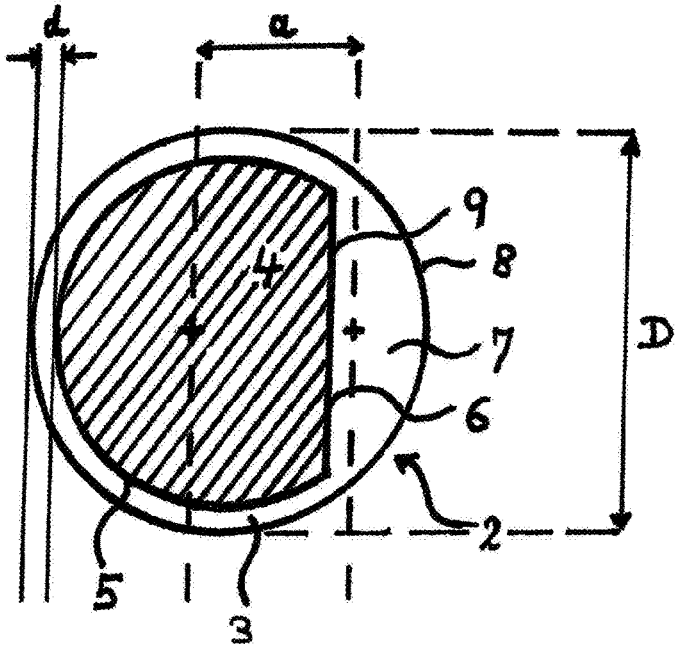
FIG. 3 is a large-scale cross section through a continuous filament preferably used in the invention and having an eccentric core-sheath configuration.

The filaments or continuous filaments made with the apparatus according to the invention or with the method according to the invention are expediently 2 bicomponent filaments or multicomponent filaments. These are preferably bicomponent filaments or multicomponent filaments with side-by-side configuration or with eccentric core-sheath configuration. In the scope of the invention, bicomponent filaments or multicomponent filaments having an eccentric core-sheath configuration and very particularly preferably having an eccentric core-sheath configuration of the type shown in FIG. 3 are particularly preferred. In FIG. 3, a cross section through a continuous filament 2 having the preferred special core-sheath configuration is shown. In the case of these continuous filaments 2, the sheath 3 has a region of uniform thickness d or a substantially region of uniform thickness d in the filament cross section, preferably in this embodiment over more than 50%, preferably over more than 55% of the filament circumference. Preferably and here, the core 4 of the filaments 2 occupies more than 65% of the filament cross section of the filaments 2. As recommended and here, the core 4, seen in the filament cross section, is of pie-shaped like a segment of a circle. Expediently and here, this core 4 has a circular arcuate peripheral portion 5 and a secantal peripheral portion 6 with regard to its circumference. Preferably and here, the arcuate peripheral portion of the core 4 takes up over 50%, preferably over 55% of the circumference of the core 4. Expediently and here, the sheath 3 of the filaments 2, seen in the filament cross section, is formed outside the sheath region with the region of uniform thickness d in the shape of a segment of a circle. This circular segment 7 of the sheath 3 has, as recommended and here, an arcuate peripheral portion 8 and a linear peripheral portion 9 with regard to its circumference. The thickness d or the average thickness d of the sheath 3 at its part of uniform thickness is preferably 0.5% to 8%, in particular 2% to 10% of the filament diameter D. In this embodiment, the thickness d of the sheath 3 may be at its region of uniform thickness of 0.05 μm to 3 μm.

The invention claimed is:

1. An apparatus for making a nonwoven web, the apparatus comprising:

an air-permeable deposit conveyor moving in a horizontal travel direction;

a spinneret for spinning and depositing continuous filaments on a deposit region of the conveyor, whereby the filaments form a nonwoven web thereon and are transported downstream from the deposit region in the direction by the conveyor;

a first preconsolidater for a first preconsolidation of the nonwoven web spaced downstream along the conveyor from the deposit region;

a second preconsolidater for a second preconsolidation of the nonwoven web spaced downstream by a suction gap along the conveyor from the first preconsolidater; and a suction device for drawing air or process air through the deposit conveyor at the deposit region at a first predetermined speed, at the first preconsolidater at a speed lower than the first predetermined speed, at the second preconsolidater at a second predetermined speed, and in the suction gap at a third predetermined speed equal to at most less than the first or the second predetermined speeds.

2. The apparatus according to claim 1, wherein the entire suction gap is formed by the deposit conveyor on which the filaments for the nonwoven web are deposited and on which the first and second preconsolidation takes place.

3. The apparatus according to claim 1, wherein only the first preconsolidater is provided between the deposit region of the filaments and the suction gap.

4. An apparatus for making a nonwoven web, the apparatus comprising:

an air-permeable deposit conveyor moving in a horizontal travel direction;

a spinneret for spinning and depositing continuous filaments on a deposit region of the conveyor, whereby the filaments form a nonwoven web thereon and are transported downstream from the deposit region in the direction by the conveyor;

a first preconsolidater for a first preconsolidation of the nonwoven web spaced downstream along the conveyor from the deposit region;

a second preconsolidater for a second preconsolidation of the nonwoven web spaced downstream by a suction gap along the conveyor from the first preconsolidater; and a suction device for drawing air or process air through the deposit conveyor at the deposit region and/or at the first preconsolidater at a first predetermined speed, at the second preconsolidater at a second predetermined speed lower than the first predetermined speed, and in the suction gap at a third predetermined speed equal to at most less than the first or the second predetermined speeds.

5. The apparatus according to claim 1, wherein the first preconsolidater is a hot-air knife.

6. An apparatus for making a nonwoven web, the apparatus comprising:

an air-permeable deposit conveyor moving in a horizontal travel direction;

a spinneret for spinning and depositing continuous filaments on a deposit region of the conveyor, whereby the filaments form a nonwoven web thereon and are transported downstream from the deposit region in the direction by the conveyor;

a first preconsolidater for a first preconsolidation of the nonwoven web spaced downstream along the conveyor from the deposit region;

a second preconsolidater for a second preconsolidation of the nonwoven web spaced downstream by a suction gap along the conveyor from the first preconsolidater;

a suction device for drawing air or process air through the deposit conveyor at the deposit region and/or at the first preconsolidater at a first predetermined speed, at the second preconsolidater at a second predetermined speed, and in the suction gap at a third predetermined speed equal to at most less than the first or the second predetermined speeds, and a third preconsolidater in the suction gap and movable between a position disengaged from the web and conveyor and a position engaging the web and conveyor and thereby consolidating the web.

7. The apparatus according to claim 6, wherein the third preconsolidater has a pair of compacting rollers one of which is pivotable between a position engaging the web and a position disengaged from the web, and the other of which is movable between a position engaging the conveyor and a position disengaged from the conveyor.

8. The apparatus according to claim 1, wherein the second preconsolidater is a hot-air oven.

9. A method of making a nonwoven web, the method comprising the steps of:

displacing an air-permeable mesh-belt conveyor in a horizontal travel direction;

spinning and then depositing crimped continuous filaments as a web at a deposit region on the air-permeable mesh-belt conveyor;

drawing air through the web and the conveyor at the deposit region at a first predetermined speed;

preconsolidating the web on the conveyor at a first preconsolidation stage downstream in the direction from the deposit region;

drawing air through the web and the conveyor at the first preconsolidation stage at a second predetermined speed;

preconsolidating the web on the conveyor at a second preconsolidation stage spaced downstream in the direction by a suction gap from the first preconsolidation stage;

drawing air through the web at the second preconsolidation stage at a third predetermined speed; and at the suction gap either not drawing air through the web and the conveyor, or drawing air through the web and the conveyor at a fourth predetermined speed equal at most to less than the second predetermined speed.

10. The method according to claim 9, wherein the fourth predetermined speed is less than the third predetermined speed.

11. The method according to claim 9, wherein the fourth predetermined speed is greater than the third predetermined speed.

12. The method according to claim 9, wherein the fourth predetermined speed is less than the second predetermined speed.

13. The method according to claim 9, wherein the fourth predetermined speed is greater or smaller than the third predetermined speed.

14. The method according to claim 9, further comprising the step of;

providing in the suction gap a pair of compaction rollers movable into and out of compressive engagement with the web and conveyor for, when engaged, a third preconsolidation of the web.

15. The method according to claim 9, wherein the crimped filaments are bicomponent or multicomponent filaments having an eccentric core-sheath configuration and are each formed by a sheath that has a region of uniform thickness and takes up at least 20% of a filament cross section.

* * * * *